United States Patent [19]

Fridrich et al.

[11] 4,275,329

[45] Jun. 23, 1981

[54] ELECTRODE WITH OVERWIND FOR MINIATURE METAL VAPOR LAMP

[75] Inventors: Elmer G. Fridrich, Chardon; John M. Davenport, Lyndhurst, both of Ohio

[73] Assignee: General Electric Company, Schenectady, N.Y.

[21] Appl. No.: 974,485

[22] Filed: Dec. 29, 1978

[51] Int. Cl.[3] ..... H01J 17/06; H01J 61/06

[52] U.S. Cl. ..... 313/217; 313/331

[58] Field of Search ..... 313/217, 331

[56] References Cited

U.S. PATENT DOCUMENTS

| | | | |
|---|---|---|---|
| 2,177,703 | 10/1939 | Francis | 313/344 |
| 2,241,362 | 5/1941 | Gustin et al. | 313/40 |
| 2,473,969 | 6/1949 | Pryslak et al. | 313/331 X |
| 2,497,496 | 2/1950 | Gooskens et al. | 313/333 |
| 2,765,420 | 10/1956 | Martt | 313/344 |
| 3,168,668 | 2/1965 | Rexer | 313/217 X |
| 3,448,321 | 6/1969 | Shanks | 313/331 X |
| 3,448,322 | 6/1969 | Millikan et al. | 313/331 X |
| 3,710,169 | 1/1973 | T'Jampens et al. | 313/331 X |
| 3,992,642 | 11/1976 | McVey et al. | 313/331 X |
| 4,101,799 | 7/1978 | Wiedijk et al. | 313/331 |

*Primary Examiner*—Robert Segal

*Attorney, Agent, or Firm*—Ernest W. Legree; Lawrence R. Kempton

[57] ABSTRACT

An electrode for a miniature high pressure metal vapor lamp comprises a slender tungsten shank joined to a molybdenum inlead by a weld knot. The shank diameter is chosen above the size where melt-back starts at the intended lamp current and is provided wth a fine wire overwind fitting loosely thereon and retained in place by frictional engagement with the weld knot. The overwind reduces breakdown voltage and assures rapid glow-to-arc transition.

7 Claims, 3 Drawing Figures

0
1
2
CENTIMETERS 1
5
3
6
7
7'
4'
4
6'
3'
5'
2

7
12
13
14
6
11

7
6
12
13
4a
11

ELECTRODE WITH OVERWIND FOR MINIATURE METAL VAPOR LAMP

The invention relates to an electrode for use in high pressure metal vapor lamps and which is particularly useful in miniature metal halide lamps.

BACKGROUND OF THE INVENTION

It has until recently been generally believed that the efficacy of discharge lamps inevitably decreases as the lamp size or wattage is reduced. As a result of this view, discharge lamps for general lighting applications have not been developed in miniature sizes. However in the pending application of Daniel M. Cap and William H. Lake, Ser. No. 912,628, filed June 5, 1978, now U.S. Pat. No. 4,161,672, granted July 17, 1979, titled "High Pressure Metal Vapor Discharge Lamps of Improved Efficacy", which is assigned like this application, new miniature discharge lamps having envelope volumes of about 1 cubic centimeter or less are disclosed. These lamps have ratings starting at about 100 watts and going down to less than 10 watts. They utilize fillings preferably comprising mercury and metal halides, and have characteristics including life durations making them suitable for general lighting purposes. Despite the low input wattage, ratios of arc watts to electrode watts similar to those in larger sizes of lamps are maintained by increasing the mercury vapor pressure at the same time as the discharge volume is decreased. It is necessary to maintain the desired electrode temperature with the reduced energy input, and this is achieved primarily by reducing the physical size of the electrodes and inleads in order to reduce the heat loss from them. The very small size of these electrodes poses severe design and manufacturing problems of a different kind than those encountered with electrodes for conventional size lamps.

SUMMARY OF THE INVENTION

The object of the invention is to provide a new electrode of small physical size suitable for use in miniature high pressure metal vapor arc tubes, which achieves easy starting and good lamp maintenance and which is cheap and easy to manufacture.

According to the invention, the electrode comprises a slender tungsten shank of a diameter not much above the size where melt-back starts at the intended lamp current and having an open and loose-fitting overwind coiled therearound. The overwind is made of fine wire relative to the shank and is retained in place by frictional engagement with an enlargement near the root end of the shank which it overlaps. The frictional engagement is adequate to retain the overwind in place while the electrode is being sealed into the vitreous envelope, and may also suffice during life. However, it is preferred to have a portion of the overwind overlapping the enlargement embedded in the glass or fused silica of the envelope for a more secure anchorage.

In a preferred embodiment suitable for miniature lamps operating at currents of less than 500 milliamperes, a 7 mil tungsten shank is used which is welded to a molybdenum inlead and the overwind is of 2.5 mil tungsten wire coiled to fit loosely around the shank.

DETAILED DESCRIPTION

Figure 1:
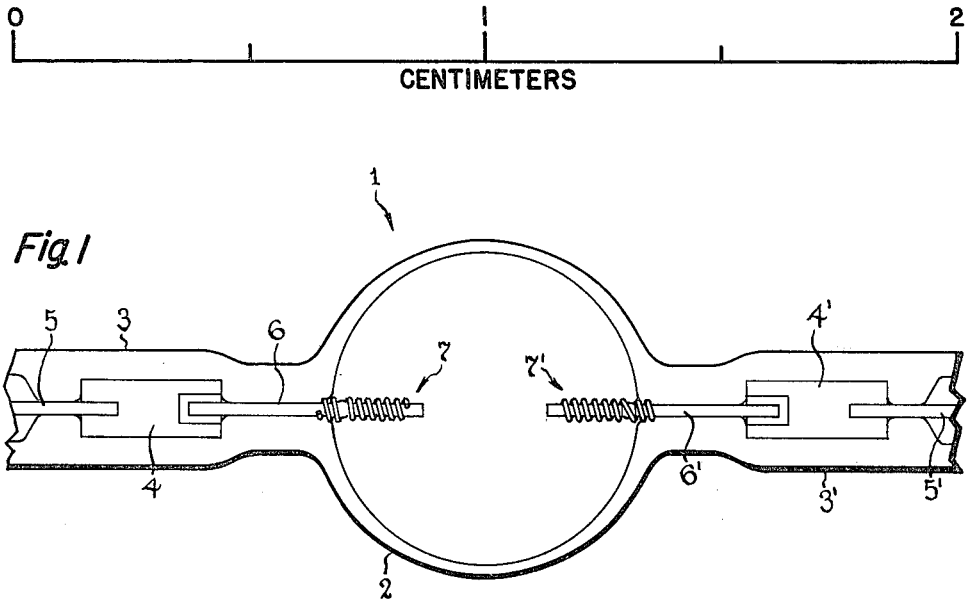
FIG. 1 illustrates, to the scale shown above the figure a miniature discharge lamp provided with a pair of electrodes embodying the invention.

The invention is particularly useful for miniature metal halide lamps such as those described in the previously mentioned copending application of Cap and Lake, an example of which is illustrated in FIG. 1. Such a lamp may comprise a small arc tube 1, generally less than 1 cc in volume, whose size may be judged from the centimeter scale shown above. The envelope is made of quartz or fused silica and comprises a central bulb portion 2 which may be formed by the expansion of quartz tubing. The neck portions 3,3' are formed by collapsing or vacuum sealing the tubing upon the foil portions 4,4' of inleads which include outer wire portions 5,5' projecting externally of the necks, and inner wire portions 6,6' extending through the necks into the bulb portion. The tungsten electrodes 7,7' are secured to and extend from the inner wire portions 6,6'.

A suitable filling for the envelope comprises argon at a pressure of several torr to serve as starting gas, and a charge comprising mercury and one or more metal halides, for instance NaI, $ScI_3$ and $ThI_4$. The charge may be introduced through an exhaust tube (not shown) extending from the side of the bulb and which is then eliminated by tipping off. Alternativey, the charge may be introduced into the arc chamber through one of the necks before sealing in the second electrode; in such case the arc chamber portion is chilled during the heat-sealing of the neck to prevent vaporization of the charge. The arc tube is usually mounted within an outer protective envelope or jacket (not shown) having a base to whose contact terminals inlead portions 5,5' of the arc tube are connected.

The invention is concerned with the electrode structure 7 which is mounted or formed upon the end of the shank 6. High pressure metal vapor arc lamps commonly utilize compact self-heating electrodes, a common design being a single or a two-layer coil on a tungsten shank with the interstices between turns being filled with emissive material. Materials commonly used are alkaline earth oxides in the case of mercury vapor lamps, and thorium oxide in the case of metal halide lamps. In metal halide lamps comprising scandium iodide and thorium iodide in the fill, reliance is placed upon pyrolitic decomposition of the thorium iodide followed by condensation of thorium metal on the electrode surface particularly at the tip of the shank, to provide a surface which emits electrons efficiently. However we have found that none of the prior art structures give optimum performance in miniature metal halide lamps, particularly those containing scandium and thorium iodides and operated on high frequency ballasts.

Figure 2:
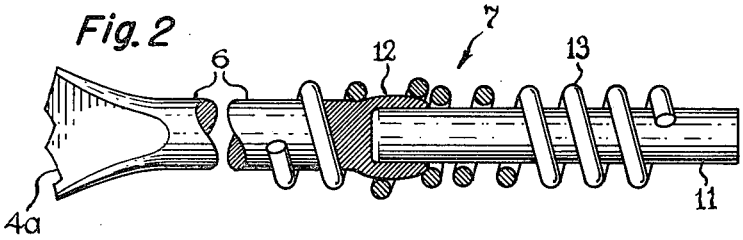
FIG. 2 is an enlarged partly sectioned view of an electrode embodying the invention.

We have found that an electrode design consisting of a tungsten shank with a loose-fitting coiled overwind, appropriately miniaturized, gives definite performance advantages, and our invention provides a structure which is cheap and easy to manufacture notwithstanding its small size. Referring to FIG. 2, the electrode 7 comprises a tungsten shank 11 which is slender but nevertheless large enough in diameter that melt-back does not occur at the intended lamp current. In this embodiment, the inlead is molybdenum wire having an intermediate foliated portion 4*a* rolled or hammered therein. The tungsten shank is joined to the inner portion 6 of the molybdenum inlead in a so-called weld knot 12. The weld knot is not a true weld with intermingling of metals, but an overlapping of the tungsten by the molybdenum which softens at a lower temperature. The weld or join is made by passing welding current, suitably obtained by a capacitor discharge, through the molybdenum and tungsten parts while pressing them axially together; the molybdenum softens more than tungsten and overlaps the tungsten producing an enlargement or weld knot. As seen in the drawing, the weld knot is appreciably larger in diameter or cross-section than the tungsten shank. The overwind 14 is formed by winding 2.5 mil tungsten wire on a 7 mil mandrel, cutting off an appropriate length, and then slipping the cut length over the tungsten shank and forcing the inner end over the weld knot. The spring-back in the coil assures a loose fit on the shank while the enlargement at the weld knot provides a frictional engagement adequate to retain the overwind in place. The portion of the coil which overlaps the weld on the foil side of the inlead may be partly embedded in the fused silica when the inlead-electrode assembly is sealed into the bulb, and the overwind is thereby permanently anchored in place.

Figure 3:
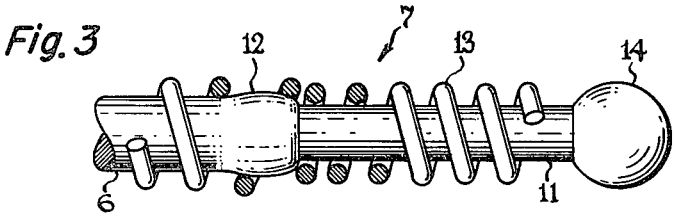
FIG. 3 is an enlarged view of another electrode embodying the invention and provided with a balled end to the shank.

When the coil 13 is mounted on the shank 7, the shank protrudes a short distance beyond the coil, for instance 0.015 to 0.025". After the arc is ignited and the lamp has heated up and reached a stable operating condition, the arc attaches to the tip of the shank. The illustrated electrode is suitable for a miniature metal halide lamp of 25 to 35 watts size which operates with a current from 400 to 500 milliamperes. At the upper end of this current range and even more so if it is exceeded, the shank tip tends to round off and form a hemispherical end by melting during lamp operation. This of course means that the electrode lengths and the arc gap are changing during life of the lamp, along with any parameters and operating characteristics dependent thereon. However once the shank tip has rounded and even more so if it has balled up, further melting back is inhibited and the electrode length and arc gap tend to stabilize. Accordingly, such stabilization may be achieved by initially operating the lamp at an excessive current just long enough to form a molten ball on the shank tip. Alternatively, such a ball may be formed during electrode fabrication by using a plasma torch to melt back a shank protrusion of adequate length, or by welding additional metal on the end of the shank. Such a ball is shown at 14 in FIG. 3 having a diameter of approximately 0.015". The combination of a loose-fitting coil overwind with a balled end on the electrode shank reduces electrode erosion while maintaining low starting voltage and fast glow-to-arc transition time.

Our invention lends itself particularly well to achieving a cheap and easily manufactured electrode in conjunction with a molybdenum inlead which is joined to a tungsten shank in a weld knot. It is convenient to use a one-piece molybdenum inlead having an integral flattened portion 4*a* as shown in FIG. 2 for the inlead; since with such an inlead a weld knot between the molybdenum end and the tungsten shank is necessary in any event, this arrangement is favored for our electrode. However while this is a preferred structure, it is not necessary to have a juncture of dissimilar metals nor is it essential to have a weld knot. A suitable swelling or enlargement or deformation of the electrode shank at its root end which is adequate to achieve the required frictional engagement of the overwind may be used.

What we claim as new and desire to secure by Letters Patent of the United States is:

1. A high pressure metal vapor lamp arc tube comprising a fused silica envelope containing an ionizable fill including vaporizable metal, self-heating electrodes sealed into opposite ends of said envelope, at least one of said electrodes comprising a tungsten shank exceeding the wire size at which melt-back occurs at the current level in said lamp, said shank being supported by a molybdenum inlead sealed into the envelope and having a weld knot to which said shank is joined and an open overwind of fine wire fitting loosely on said shank and retained in place by frictional engagement with the enlargement in the inlead at the weld knot.

2. A lamp as in claim 1 wherein the portion of the overwind overlapping the weld knot in the direction of the seal is at least partly embedded in the fused silica of the envelope.

3. A lamp as in claim 1 wherein said one electrode has a ball-like enlargement at the distal end.

4. A lamp as in claim 1 for a.c. operation wherein both electrodes are constructed like said one electrode.

5. A lamp as in claim 1 containing mercury and metal halides including thorium.

6. A lamp as in claim 1 containing mercury, sodium iodide, scandium iodide and thorium iodide.

7. A miniature lamp as in claim 6 for operation at a current of less than 500 milliamperes wherein the electrode shank is tungsten wire of approximately 7 mils and the overwind is tungsten wire of approximately 2.5 mils.

* * * * *